US006471154B2

(12) United States Patent
Toth

(10) Patent No.: US 6,471,154 B2
(45) Date of Patent: Oct. 29, 2002

(54) AUTOMATIC ROLL TENSIONER AND MATERIAL DISPENSING SYSTEM USING THE SAME

(75) Inventor: Zsolt Toth, Tuckahoe, NY (US)

(73) Assignee: Zsolt Design Engineering, Inc., Tuckahoe, NY (US)

( * ) Notice: Subject to any disclaimer, the term of this patent is extended or adjusted under 35 U.S.C. 154(b) by 0 days.

(21) Appl. No.: 09/819,640

(22) Filed: Mar. 29, 2001

(65) Prior Publication Data

US 2002/0139890 A1 Oct. 3, 2002

(51) Int. Cl.[7] ..... B65H 23/06

(52) U.S. Cl. ..... 242/421.3; 242/557; 493/395; 493/464

(58) Field of Search ..... 242/421.3, 334.5, 242/557, 588, 595.1, 592, 421; 493/395, 967, 464

(56) References Cited

U.S. PATENT DOCUMENTS 4,809,921 A 3/1989 Dueck et al.
5,131,903 A 7/1992 Levine et al.
5,643,647 A 7/1997 Wischusen, III
5,749,539 A 5/1998 Ratzel et al.
5,938,580 A 8/1999 Sickmann
6,179,765 B1 1/2001 Toth

*Primary Examiner*—John Q. Nguyen
(74) *Attorney, Agent, or Firm*—Antonelli, Terry, Stout, Kraus, LLP

(57) ABSTRACT

An automatic roll tensioner for a material dispensing system enables a material, e.g., paper or plastic, to be unwound from a roll of the material by pulling the material from the roll while maintaining tension on the material when pulling suddenly stops. The roll of material is positioned in the roll tensioner such that it can be rotated about a longitudinal axis of the roll by pulling the material from the roll to unwind material from the roll. A mechanism actuated by the weight of the roll of material applies frictional resistance to the rotation of the roll at a plurality of circumferentially spaced locations on the periphery of the roll. An apparatus for converting sheets of paper into cushioning dunnage advantageously employs the automatic roll tensioner.

28 Claims, 4 Drawing Sheets

AUTOMATIC ROLL TENSIONER AND MATERIAL DISPENSING SYSTEM USING THE SAME

REFERENCE TO RELATED APPLICATION

Commonly owned U.S. patent application Ser. No. 09/819,998, filed Mar. 29, 2001, filed concurrently herewith, for Compact Apparatus and System for Creating and Dispensing Cushioning Dunnage, is hereby incorporated by reference.

TECHNICAL FIELD

The invention relates to an apparatus for enabling a material to be unwound from a roll of the material by pulling the material from the roll while maintaining tension on the material when pulling suddenly stops. An implementation is an automatic roll tensioner for a material dispensing system in an apparatus for converting sheets of paper into void fill and cushioning dunnage.

BACKGROUND

It is known to dispense material such as paper or plastic from a roll of the material by pulling the material to unwind it from the roll. Equipment can be used to unwind the material from the roll or unwinding can be accomplished manually by pulling on the material. As an example, paper which is used to form packaging dunnage is supplied on rolls mounted to a supply end of a dunnage conversion machine. The rolls are generally rotatably supported on a mounting apparatus to facilitate paper supply to the conversion machine. U.S. Pat. No. 5,749,539 discloses a relatively complex mandrel assembly for mounting a roll of paper onto a mounting frame. A two-piece spindle extends through the length of the paper, extending beyond the mounting apparatus. An end of one spindle piece must be inserted through one end of the paper roll and into an opening in an end of a second spindle piece, which must be inserted into a second end of the paper roll to form the spindle. Plugs which are rotatably mounted near each end of the spindle support either end of the paper roll on the spindle. The plugs are retained on the spindle by a plurality of pins that must be inserted diametrically through the spindle to form abutments at opposite axial ends of the plugs. The spindle is then fixed to the mounting frame by additional pins which must be inserted through the spindle into the mounting frame, preventing the spindle from rotating relative to the mounting frame.

As the paper is drawn from the roll, the plugs rotate with the roll and the plugs rotate freely about the fixed spindle. This prior art mandrel assembly does not provide the ability to apply tension to the paper roll except for whatever rotational friction is generated between the spindle and the plugs. In the absence of tension, paper backlash may occur when the drive motor is stopped to cut the paper. Excess backlash can separate the paper from the forming mechanism, reducing the forming and shaping capabilities of the machine, producing an unsatisfactory product. That is, the roll of material can keep turning even after the material has suddenly stopped being pulled forward which causes the material to lose tension and slacken, and extra material to hang loosely from the roll. Then, when the material is quickly pulled forward again, the slack is taken out before the roll begins turning, causing the material to rip. There is a need for an apparatus which can be integrated with any type of equipment that unwinds materials such as paper or plastic from a roll where constant material tension can be maintained and controlled.

SUMMARY

The present invention addresses this need in providing an apparatus for enabling a material to be unwound from a roll of the material by pulling the material from the roll while maintaining tension on the material when pulling suddenly stops. In a disclosed, example embodiment, the apparatus comprises an arrangement for positioning a roll of material such that the roll can be rotated about a longitudinal axis of the roll by pulling the material from the roll to unwind material from the roll, and a mechanism actuated by the roll of material when the roll of material is positioned by the arrangement for applying frictional resistance to the rotation of the roll of material at a plurality of circumferentially spaced locations on the periphery of the roll of material.

The example embodiment is in the form of an automatic roll tensioner especially for use in an apparatus for converting sheets of paper into void fill and cushioning dunnage. In the apparatus, a supply assembly supports the roll of paper to be converted. A conversion assembly through which paper from the roll of material can be pulled folds and forms the paper into pillow-like shapes for use as cushioning dunnage. The automatic roll tensioner of the invention positions the roll of paper such that the roll can be rotated about a longitudinal axis of the roll by pulling the material from the roll to unwind material from the roll. A mechanism of the roll tensioner is actuated by the roll of material when the roll is positioned by the arrangement for applying frictional resistance to the rotation of the roll of material at a plurality of circumferentially spaced locations on the periphery of the roll as a function of the weight of the roll of material positioned by the arrangement. The roll tensioner automatically adjusts tension based on the weight of the roll. The material roll does not require a core or support such as a rod or mandrel.

These and other features and advantages of the present invention will become more apparent from the following description when taken in connection with the accompanying drawings which show, for purposes of illustration only, one example embodiment in accordance with the present invention.

BRIEF DESCRIPTION OF DRAWINGS

The following represents brief descriptions of the drawings, wherein.

DETAILED DESCRIPTION

Figure 1:
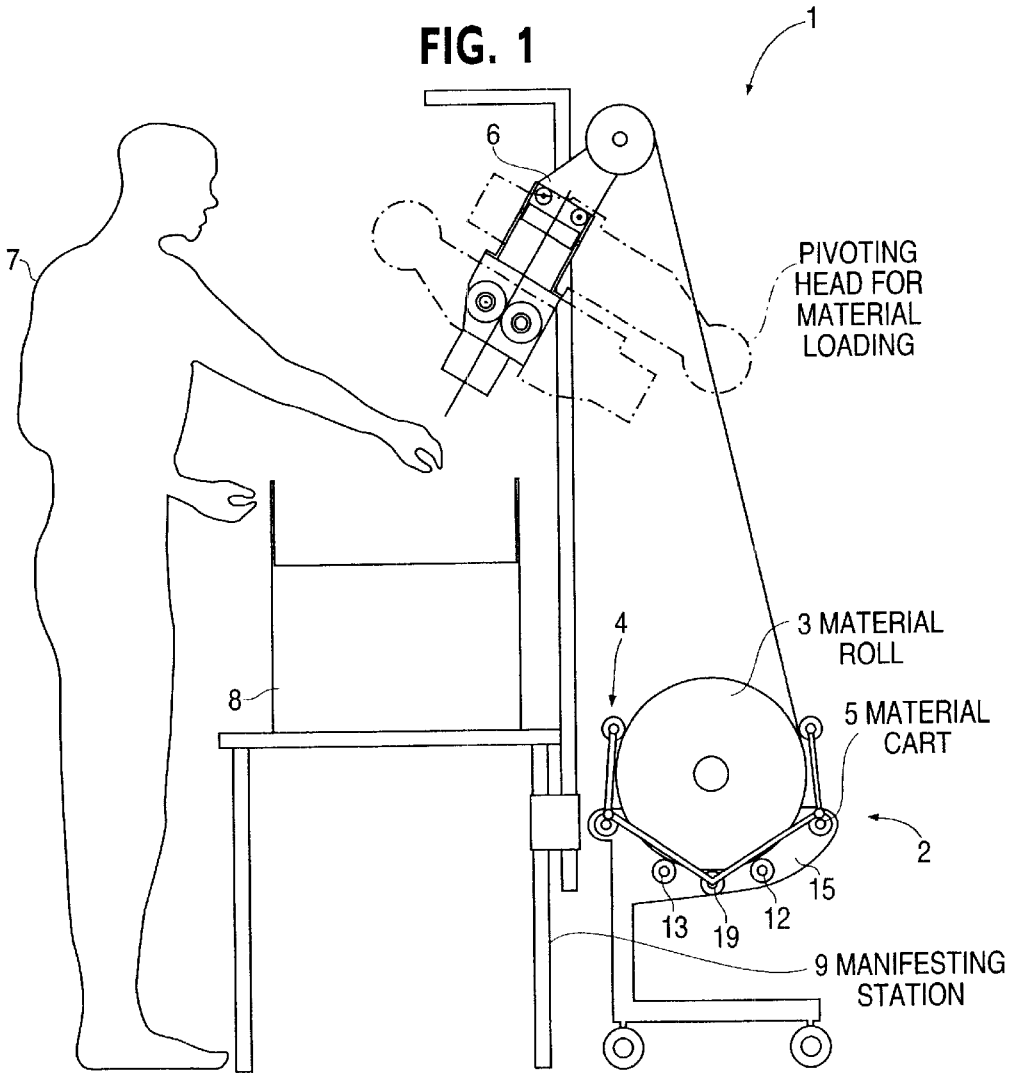
FIG. 1 is a side view of an apparatus for converting sheets of paper into void fill and cushioning dunnage according to an example embodiment of the invention.

Referring now to the drawings, an apparatus 1 of the invention for converting sheets of paper into void fill and cushioning dunnage is depicted in FIG. 1. The apparatus 1 comprises a supply assembly 2 supporting a roll 3 of the paper to be converted into void fill and cushioning dunnage. The supply assembly 2 includes an automatic roll tensioner 4 according to the invention mounted on a wheeled material cart 5 shown generally in FIG. 1. A conversion assembly 6 pulls paper from the roll of material 3 and folds and forms the paper into pillow-like shapes for use as cushioning dunnage. The conversion assembly can be of known construction or can be formed in the manner shown in more detail in Applicant's aforementioned related U.S. Patent Application, the disclosure of which has been incorporated by reference as noted above. An operator 7 is shown in position for placing packaging dunnage from the conversion assembly 6 into a container 8 supported on a manifesting station 9 of the apparatus 1. Discrete lengths of dunnage formed by the conversion assembly 6 can be separated by cutting in a final operation of the conversion assembly 6, or the operator can tear the individual lengths of dunnage issuing from the conversion assembly at locations of perforations formed in the paper by the conversion assembly 6 as disclosed in the aforesaid related application.

Figure 2:
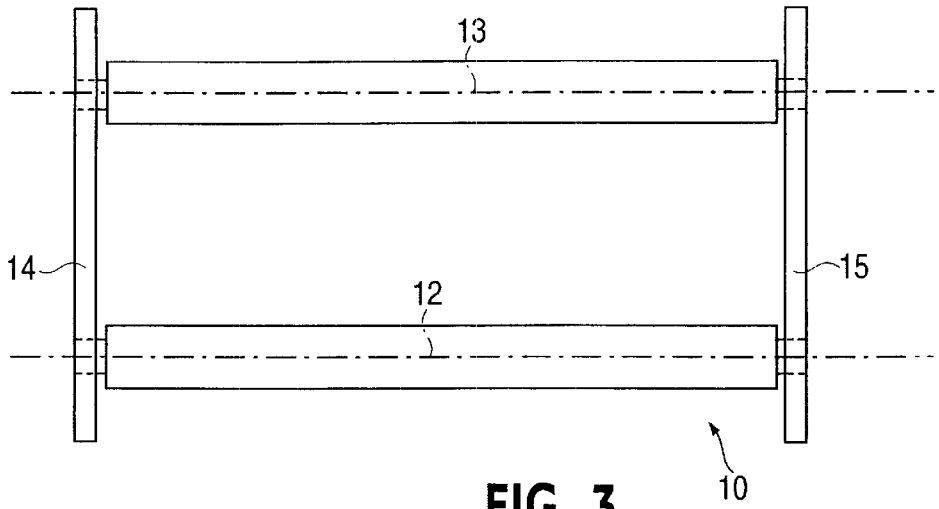
FIG. 2 is a top view of the automatic roll tensioner of the invention in the apparatus of FIG. 1, the mechanism for applying frictional resistance to the rotation of the roll of paper in the roll tensioner not being shown.
Figure 3:
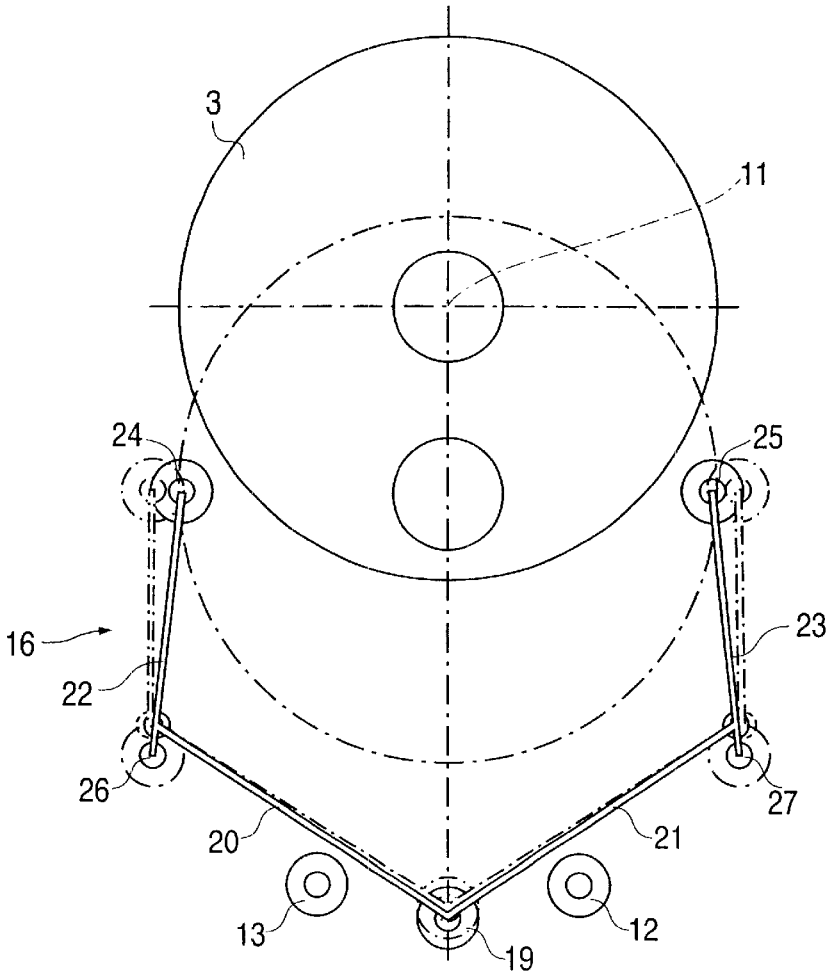
FIG. 3 is a schematic side view of the roll tensioner as a roll of paper is being inserted from above into the roll tensioner.

The automatic roll tensioner 4 comprises an arrangement 10, FIG. 2, for positioning the roll 3 such that the roll can be rotated about a longitudinal axis of the roll, axis 11 directed normal to the plane of the drawing in FIG. 3, by pulling the free end of the material from the roll to unwind material from the roll. The arrangement 10 comprises two laterally spaced, parallel positioning rollers 12 and 13 for centering the roll 3 in the roll tensioner and preventing the roll from jumping out of the roll tensioner as the size of the roll is reduced by unwinding material therefrom. The two positioning rollers 12 and 13 are rotatably mounted at their respective ends between side plates 14 and 15 illustrated in FIG. 2. One of the side plates is generally shown in FIG. 1.

Figure 4:
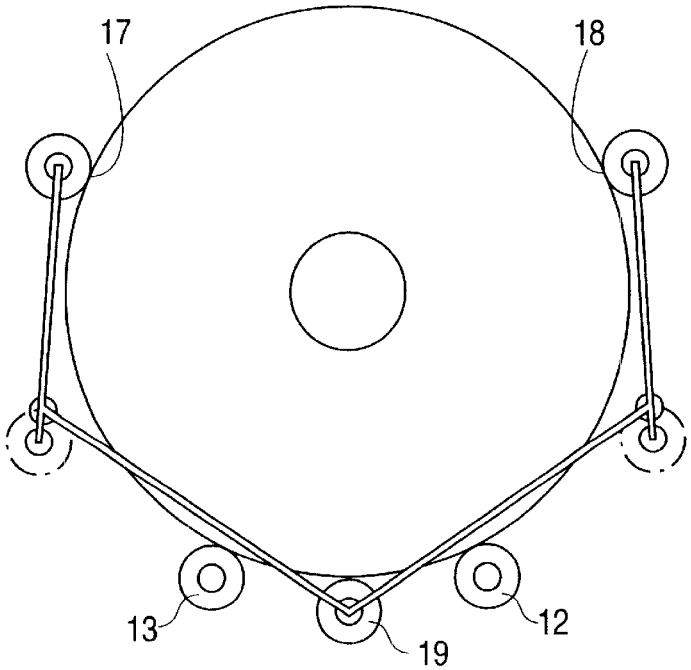
FIG. 4 is a schematic side view of the roll tensioner with the roll of paper positioned in the roll tensioner for dispensing paper from the roll by pulling the paper and unwinding it from the roll.
Figure 5:
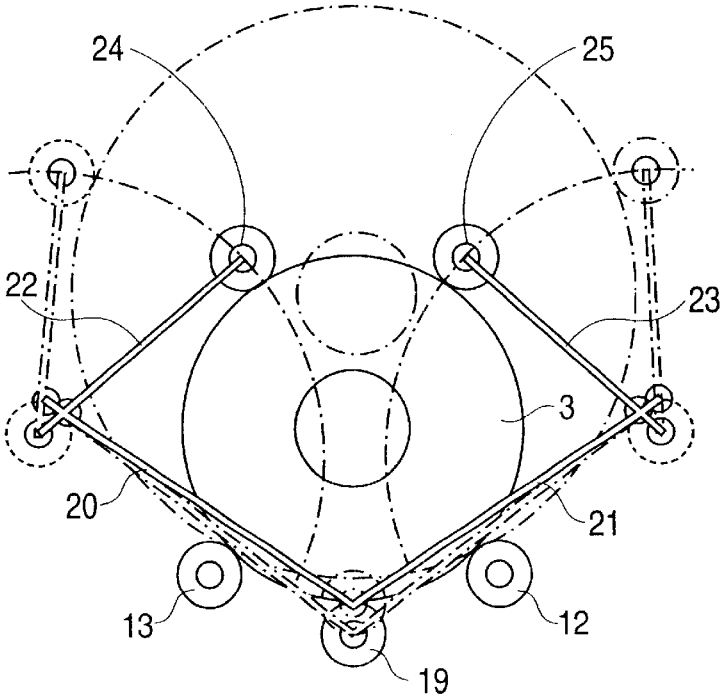
FIG. 5 is a schematic side view of the roll tensioner showing the roll half used.
Figure 6:
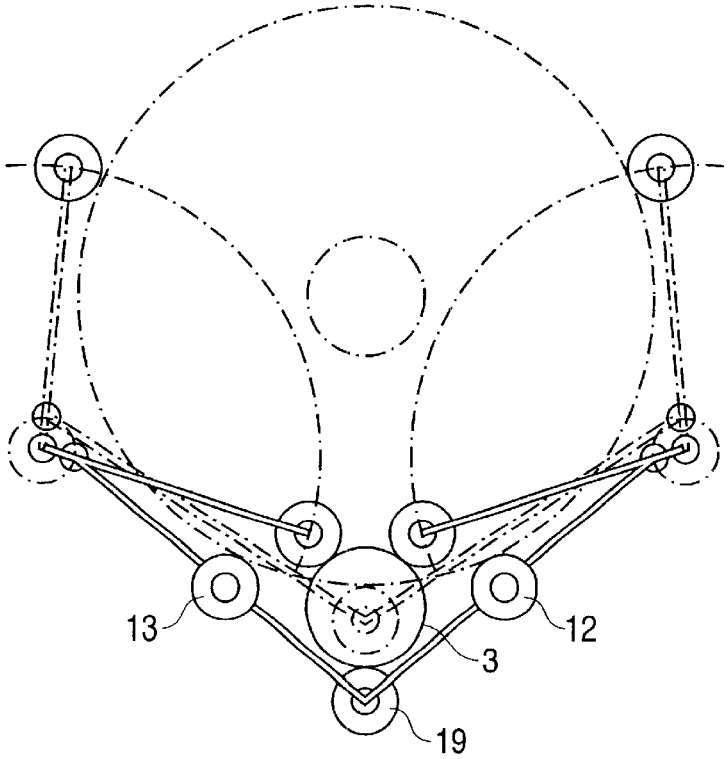
FIG. 6 is a schematic side view of the roll tensioner wherein the material roll is empty.
Figure 7:
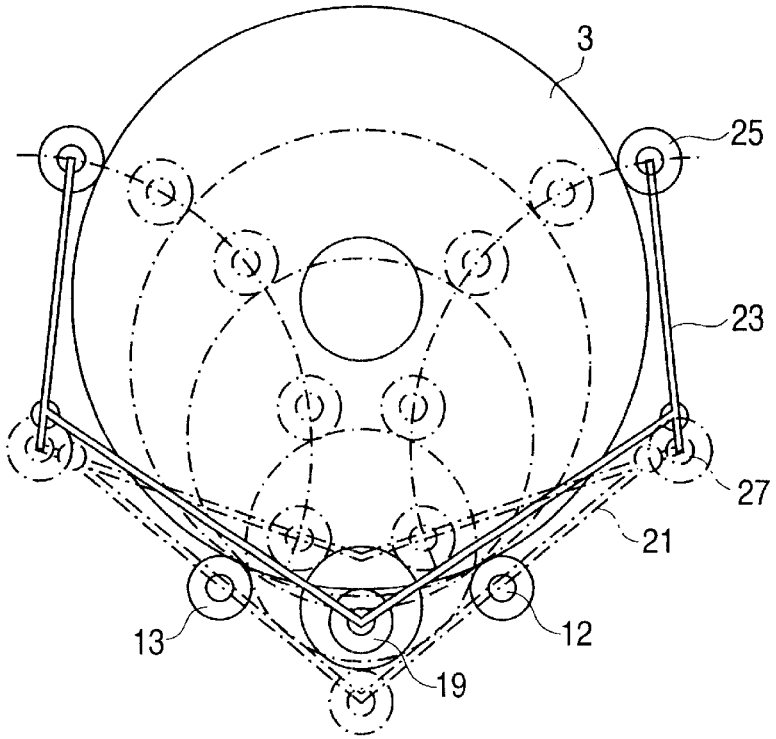
FIG. 7 is a schematic side view of the roll tensioner with the roll and mechanism for applying frictional resistance to the roll being shown in the phantom in several positions as the size of the roll decreases with pulling of material from the roll.

The automatic roll tensioner 4 further comprises a mechanism 16 which is actuated by the roll 3 when the roll is positioned by the arrangement 10 for applying frictional resistance to the rotation of the roll at a plurality of circumferentially spaced locations 17 and 18, see FIG. 4, on the periphery of the roll of material. More particularly, the mechanism 16 includes a weight transfer roller 19 which is rotatably supported at its ends between the positioning rollers 12 and 13 by respective pairs of weight transfer roller linkage arms 20 and 21. The weight transfer roll and two pairs of weight transfer roller linkage arms are mounted between the two side plates 14 and 15 of the roll tensioner 4 such that the roller 19 extends parallel to positioning rollers 12 and 13. The upper ends of the weight transfer linkage arms are pivotally connected to respective ones of tensioning roller linkage arms 22 and 23.

Tensioning rollers 24 and 25 are rotatably supported at their respective ends by the free ends of the corresponding tensioning roller linkage arms 22 and 23. The opposite ends of the tensioning roller linkage arms 22 and 23 are pivotally connected at fixed positions 26 and 27 to the respective side plates 14 and 15. The two tensioning arm assemblies, each formed with a tensioning roller and two tensioning roller linkage arms, constitute force application devices for applying rolling frictional resistance to the rotation of the roll 3 at circumferentially spaced locations, 17 and 18 in FIG. 4. For this purpose, the tensioning rollers 24 and 25 are biased with force against the roll 3 by the downward movement of the weight transfer linkage in response to the downward movement of the weight transfer roller for applying rolling frictional resistance to the rotation of the roll 3.

In operation, a roll 3 of paper, for example, is placed in the automatic roll tensioner 4. The roll 3 is positioned in the tensioner 4 by the positioning rollers 12 and 13. The weight of the roll of material causes the weight transfer roller 19 to move down, see the sequence of movement shown in FIGS. 3–7. As the weight transfer roller moves down, the weight transfer linkage arms 20 and 21 at each end of the weight transfer roller are pulled downward and inward into a V motion. As the four weight transfer roller linkage arms move into a V position, the tensioning roller linkage arms 22 and 23 swing toward each other, causing the tensioning rollers 24 and 25 to apply pressure onto the roll of material. This pressure maintains the tension on the material as it is unwound from the roll of material; the greater the weight of material, the greater the tension. As indicated above, the positioning rollers 12 and 13 keep the roll centered and prevent it from jumping out of the device as the size of the roll is reduced.

The automatic roll tensioner 4 in the example embodiment does not require that the material roll 3 have a core. Further, the material roll does not need supports such as rods or mandrels at its central, longitudinal axis. As long as the roll physically fits into the roll tensioner 4, roll size can vary in length and diameter without affecting roll placement or tension control. In the example embodiment, the roll tensioner 4 will accommodate any roll less than 14 inches in diameter and less than 32 inches in length. Larger roll tensioners could be made to accommodate larger rolls.

The roll tensioner 4 automatically adjusts tension based on the weight of the roll 3. No other adjustments are necessary by the operator. The roll tensioner operates without springs, or air or electrical supply and comprises few parts, so it is inexpensive and simple to assemble. Reliability is also increased and maintenance reduced as there are few moving parts in the roll tensioner.

While I have shown and described only one example embodiment in accordance with the present invention, it is understood that the same is not limited thereto, but is susceptible to numerous changes and modifications as known to those skilled in art. The automatic roll tensioner can be integrated with any type of equipment that unwinds materials such as paper or plastic from a roll where constant material tension must be maintained and controlled. A roll can be placed into the device by simply dropping it into position. No additional equipment, such as a mandrel, shaft, strap, screw, clamp, etc., is needed to align the roll in the device or keep the roll in position. Therefore, we do not wish to be limited to the details shown and described herein, but intend to cover all such changes and modifications as are encompassed by the scope of the appended claims.

I claim:

1. An apparatus for enabling a material to be unwound from a roll of the material by pulling the material from the roll while maintaining tension on the material when pulling suddenly stops, said apparatus comprising:

an arrangement for positioning a roll of material such that the roll can be rotated about a longitudinal axis of the roll by pulling the material from the roll to unwind material from the roll; and a mechanism actuated by said roll of material when said roll of material is positioned by said arrangement for applying frictional resistance to the rotation of said roll of material at a plurality of circumferentially spaced locations on the periphery of said roll of material.

2. The apparatus according to claim 1, wherein said arrangement for positioning comprises two laterally spaced, parallel positioning rollers for centering said roll of material in said apparatus and preventing said roll of material from jumping out of said apparatus as the size of said roll is reduced by unwinding material therefrom.

3. The apparatus according to claim 2, further comprising two side plates between which said two positioning rollers are rotatably mounted.

4. The apparatus according to claim 1, wherein said mechanism applies said frictional resistance as a function of the weight of said roll of material positioned by said arrangement in said apparatus.

5. The apparatus according to claim 1, wherein said mechanism includes a weight transfer roller which is moved down by the weight of said roll of material when the roll of material is positioned in said apparatus by said arrangement, a weight transfer linkage connected to said weight transfer roller for movement therewith, and a plurality of force application devices at circumferentially spaced locations about the periphery of said roll of material, said devices being biased against said roll of material by the downward movement of said weight transfer linkage in response to the downward movement of said weight transfer roller for applying frictional resistance to the rotation of said roll of material.

6. The apparatus according to claim 5, wherein said force application devices comprise tensioning rollers which apply rolling frictional resistance to the rotation of the roll when forced against said roll of material.

7. The apparatus according to claim 6, wherein said tensioning rollers are supported at their ends by respective tensioning roller arms pivotally mounted on said apparatus.

8. The apparatus according to claim 7, wherein said weight transfer linkage is pivotally connected to said, tensioning roller arms.

9. An automatic roll tensioner for a material dispensing system, said roll tensioner comprising:

means for positioning a roll of material in said roll tensioner such that the roll can be rotated about a longitudinal axis of the roll by pulling material from the roll to unwind material from the roll; and a mechanism actuated by said roll of material when said roll of material is positioned by said means for positioning for applying frictional resistance to the rotation of said roll of material at a plurality of circumferentially spaced locations on the periphery of said roll of material.

10. The roll tensioner according to claim 9, wherein said means for positioning comprises two laterally spaced, parallel positioning rollers for centering said roll of material in said roll tensioner and preventing said roll of material from jumping out of said roll tensioner as the size of said roll is reduced by unwinding material therefrom.

11. The roll tensioner according to claim 10, wherein said means for positioning further comprises two side plates between which said two positioning rollers are rotatably mounted.

12. The roll tensioner according to claim 9, wherein said mechanism applies said frictional resistance as a function of the weight of said roll of material positioned by said means for positioning in said apparatus.

13. The roll tensioner according to claim 9, wherein said mechanism includes a weight transfer roller which is moved down by the weight of said roll of material when the roll of material is positioned in said roll tensioner by said means for positioning, a weight transfer linkage connected to said weight transfer roller for movement therewith, and a plurality of force application devices at circumferentially spaced locations about the periphery of said roll of material, said devices being biased with force against said roll of material by the downward movement of said weight transfer linkage in response to the downward movement of said weight transfer roller for applying frictional resistance to the rotation of said roll of material.

14. The roll tensioner according to claim 13, wherein said force application devices comprise tensioning rollers which apply rolling frictional resistance to the rotation of the roll when forced against said roll of material.

15. The roll tensioner according to claim 14, wherein said tensioning rollers are supported by respective tensioning roller arms pivotally mounted on said roll tensioner.

16. The roll tensioner according to claim 15, wherein said weight transfer linkage is pivotally connected to said tensioning roller arms for biasing said tensioning rollers with force against said roll of material.

17. An apparatus for converting sheets of paper into void fill and cushioning dunnage, said apparatus comprising:

a supply assembly supporting a roll of the paper to be converted;

a conversion assembly through which paper from said roll of material can be pulled for folding and forming paper from said roll into pillow-like shapes for use as cushioning dunnage; and wherein said supply assembly comprises an arrangement for positioning said roll of material such that the roll can be rotated about a longitudinal axis of the roll by pulling the material from the roll to unwind material from the roll; and a mechanism actuated by said roll of material when said roll of material is positioned by said arrangement for applying frictional resistance to the rotation of said roll of material at a plurality of circumferentially spaced locations on the periphery of said roll of material.

18. The apparatus according to claim 17, wherein said conversion assembly includes means for pulling the paper from said roll of paper through said conversion assembly.

19. The apparatus according to claim 17, further comprising means for separating the cushioning dunnage into discrete lengths.

20. The apparatus according to claim 17, wherein said mechanism applies said frictional resistance as a function of the weight of said roll of material positioned by said arrangement in said apparatus.

21. A material cart for enabling a material to be unwound from a roll of the material by pulling the material from the roll while maintaining tension on the material when pulling suddenly stops, said material cart comprising:

a stand with wheels;

an arrangement on said stand for positioning a roll of material on the stand such that the roll can be rotated about a longitudinal axis of the roll by pulling the material from the roll to unwind material from the roll; and a mechanism on said stand actuated by said roll of material when said roll of material is positioned by said arrangement on said stand for applying frictional resistance to the rotation of said roll of material at a plurality of circumferentially spaced locations on the periphery of said roll of material.

22. The material cart according to claim 21, wherein said arrangement for positioning comprises two laterally spaced, parallel positioning rollers for centering said roll of material on said stand and preventing said roll of material from jumping out of said material cart as the size of said roll is reduced by unwinding material therefrom.

23. The material cart according to claim 22, further comprising two side plates on said stand between which said two positioning rollers are rotatably mounted.

24. The material cart according to claim 21, wherein said mechanism applies said frictional resistance as a function of the weight of said roll of material positioned by said arrangement in said material cart.

25. The material cart according to claim 21, wherein said mechanism includes a weight transfer roller which is moved down by the weight of said roll of material when the roll of material is positioned in said material cart by said arrangement, a weight transfer linkage connected to said weight transfer roller for movement therewith, and a plurality of force application devices at circumferentially spaced locations about the periphery of said roll of material, said devices being biased against said roll of material by the downward movement of said weight transfer linkage in response to the downward movement of said weight transfer roller for applying frictional resistance to the rotation of said roll of material.

26. The material cart according to claim 25, wherein said force application devices comprise tensioning rollers which apply rolling frictional resistance to the rotation of the roll when forced against said roll of material.

27. The material cart according to claim 26, wherein said tensioning rollers are supported at their ends by respective tensioning roller arms pivotally mounted on said material cart.

28. The material cart according to claim 27, wherein said weight transfer linkage is pivotally connected to said tensioning roller arms.

* * * * *